US006341873B1

(12) United States Patent
Yang

(10) Patent No.: US 6,341,873 B1
(45) Date of Patent: Jan. 29, 2002

(54) UMBRELLA WITH AN ILLUMINATION DEVICE

(75) Inventor: Chiu-Hsiung Yang, Taipei Hsien (TW)

(73) Assignee: Jeng Tai Umbrella Mfg. Corp., Taipei Hsien (TW)

( * ) Notice: Subject to any disclaimer, the term of this patent is extended or adjusted under 35 U.S.C. 154(b) by 0 days.

(21) Appl. No.: 09/541,195

(22) Filed: Apr. 3, 2000

(51) Int. Cl.[7] ..... A45B 3/02

(52) U.S. Cl. ..... 362/102; 362/800; 135/16; 135/910

(58) Field of Search ..... 362/102, 800; 135/16, 910

(56) References Cited

U.S. PATENT DOCUMENTS

| | | | | |
|---|---|---|---|---|
| 1,166,272 A | | 12/1915 | Smithing | |
| 1,595,023 A | | 8/1926 | Probe | |
| 1,795,268 A | | 3/1931 | Thomases | |
| 2,878,366 A | | 3/1959 | Evans, Jr. | |
| 4,020,858 A | | 5/1977 | Wilson | |
| 4,031,381 A | | 6/1977 | Carver | |
| 4,093,969 A | | 6/1978 | Maynor, Jr. | |
| 4,848,385 A | | 7/1989 | Pennella | |
| 4,962,779 A | | 10/1990 | Meng | |
| 5,003,437 A | | 3/1991 | Barrett | |
| 5,063,953 A | | 11/1991 | Wu | |
| 5,135,016 A | | 8/1992 | Stiller | |
| 5,323,798 A | | 6/1994 | Yang | |
| 5,502,624 A | | 3/1996 | Tu | |
| 6,089,727 A | * | 7/2000 | Wu | 362/102 |
| 6,126,293 A | * | 10/2000 | Wu | 362/102 |

FOREIGN PATENT DOCUMENTS

| | | |
|---|---|---|
| GB | 2 222 942 | 3/1990 |
| JP | 11318524 | 11/1999 |

* cited by examiner

*Primary Examiner*—Thomas M. Sember
(74) *Attorney, Agent, or Firm*—Alan Kamrath; Rider, Bennett, Egan & Arundel, LLP

(57) ABSTRACT

An umbrella with an illumination device is disclosed. The illumination device has a top illumination assembly on the top end of the shaft, a tip illumination assembly on the free end of each rib and a control assembly to provide electricity to each illumination assembly. The top illumination assembly comprises a transparent connecting tube, a transparent tubular member, an internal wall integrally formed in the tubular member, an LED received in the tubular member and two electrical wires connected to the LED. The tip illumination assembly comprises a transparent tip, a conical hole defined in the tip, an LED and two branch electrical wires connected to the LED. The control assembly comprises a control unit in the shaft, an electrical connecting unit and two main electrical wires connected between the control unit and the electrical connecting unit. By such an arrangement, the illumination device can provide good illumination to increase the safety of using the umbrella.

20 Claims, 19 Drawing Sheets

UMBRELLA WITH AN ILLUMINATION DEVICE

BACKGROUND OF THE INVENTION

1. Field of the Invention

The present invention relates to an umbrella, and more particularly to an umbrella with an illumination device to improve the safety of using the umbrella.

2. Description of Related Art

A conventional umbrella in accordance with the prior art mainly comprises a shaft, a hub slidably mounted on the shaft, multiple ribs pivotally mounted on the shaft, multiple spreaders pivotally mounted between the hub and each of the ribs and a canopy covering the ribs. However, because visibility is limited in the rain and the conventional umbrella has no illumination device, the conventional umbrella user could easily have an accident on a dark rainy night.

Referring to FIG. 20, a U-shaped connecting member (93) is mounted on each rib (92) of a conventional umbrella to pivotally connect to one end of each spreader (94). Each spreader (94) has a flat end portion (942) that is connected to the connecting member (93) by a pivot. However, the pivotal structure between each rib (92) and the corresponding spreader (94) does not have enough space to allow wires to extend through the connecting member (93). Thus, it is difficult to mount an illumination device with wires on the conventional umbrella.

In addition, a handle is always mounted on the bottom end of the shaft for the user gripping the umbrella. A control device for releasing and expanding the canopy from the folded condition is always mounted near the handle. Referring to FIG. 21, the conventional control device comprises a curved control plate (96) received in the shaft (90). One end of the control plate (96) is mounted in the shaft (90), a pushbutton (962) is integrally formed on the other end of the plate (96), and a hook (964) is integrally formed on the plate (96) near the pushbutton (962). Both the pushbutton (962) and the hook (964) extend out of the shaft (90). The hook (964) engages with the hub that slides along the shaft (90). When the user pushes the pushbutton (962), the hook (964) retracts into the shaft (90) and disengages from the hub. The hub with all of the spreaders will then slide along the shaft (90) and the canopy will expand due to the interaction between the spreaders and the ribs.

However, because the flexibility of the conventional control plate (96) depends on the shape of the plate (96), the distance that the hook (964) can move is so small, and the reaction of the hook (964) is slow as the user pushes the button (962).

To overcome the shortcomings, the present invention tends to provide an improved umbrella to mitigate or obviate the aforementioned problems.

SUMMARY OF THE INVENTION

The main objective of the invention is to provide an improved umbrella having a shaft, multiple ribs, multiple spreaders, a canopy and an illumination device. The illumination device has an illumination assembly on the top end of the shaft, another illumination assembly on the free end of each rib and a control assembly to provide electricity to each illumination assembly. The illumination devices provide good illumination to people in the rain. This increases the decorative effect and the safety of the umbrella.

Other objects, advantages and novel features of the invention will become more apparent from the following detailed description when taken in conjunction with the accompanying drawings.

DETAILED DESCRIPTION OF PREFERRED EMBODIMENT

Figure 1:
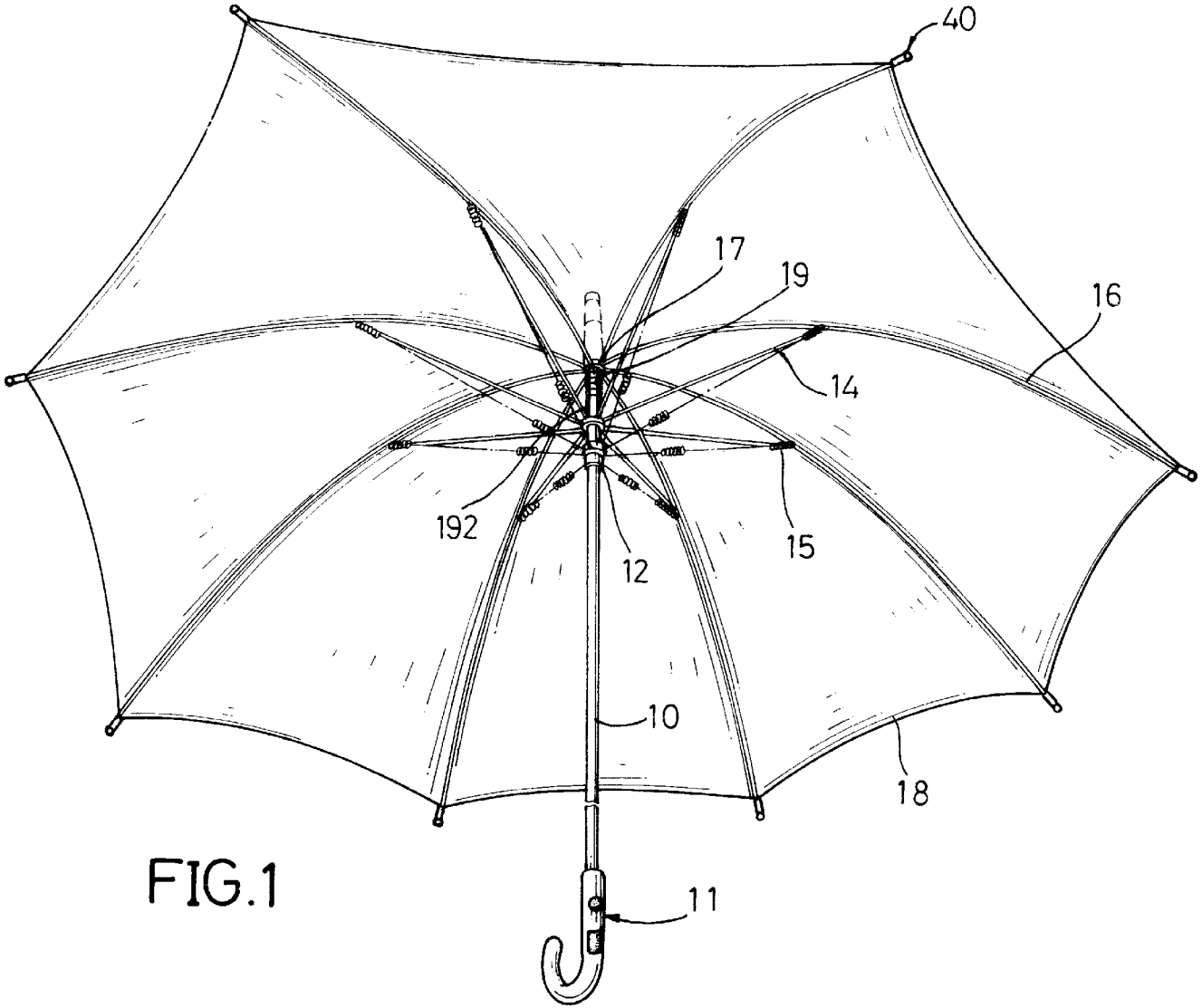
FIG. 1 is a perspective view of an umbrella with illumination devices in accordance with the present invention.
Figure 2:
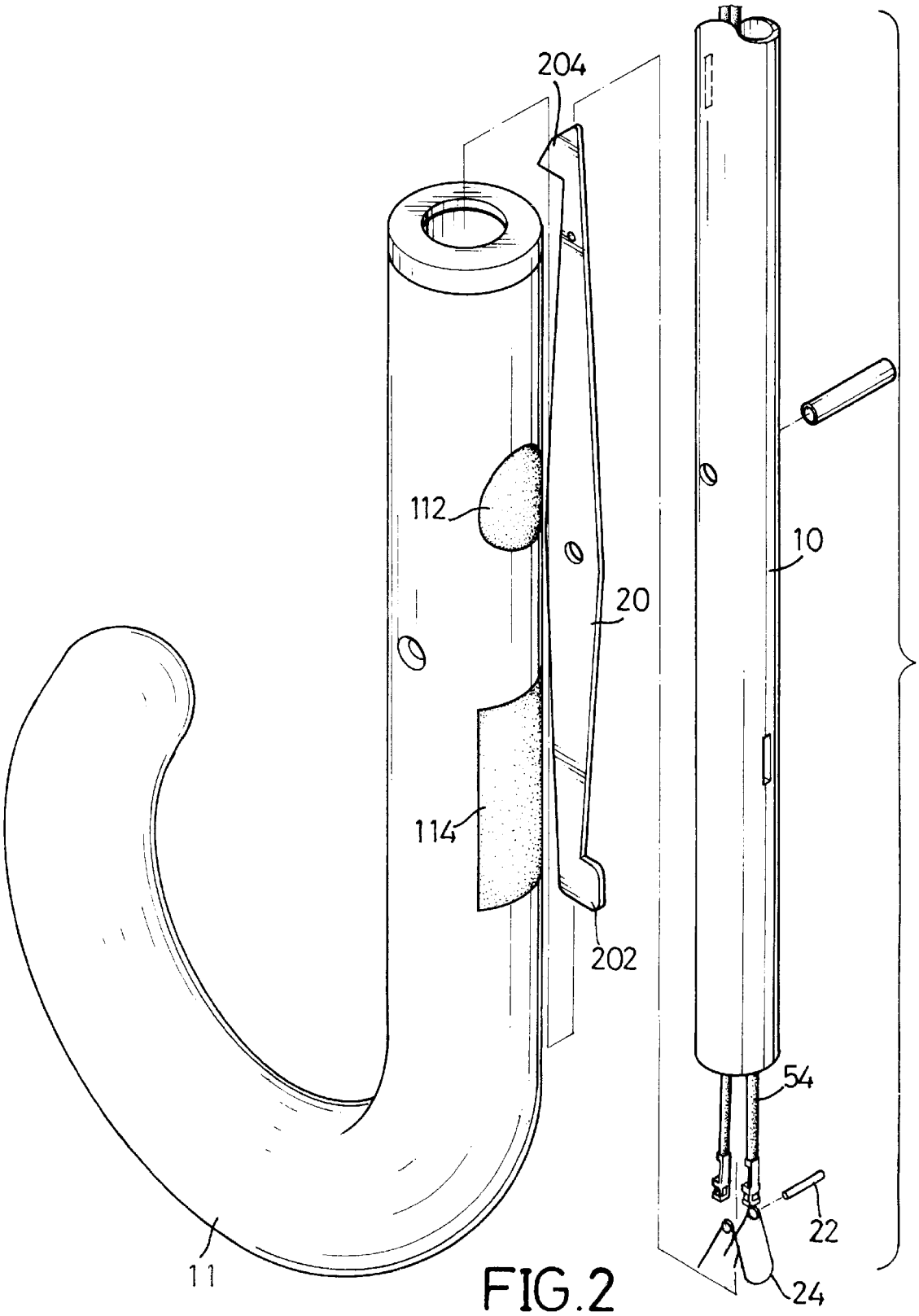
FIG. 2 is an exploded perspective view of the handle and the shaft in FIG. 1.
Figure 3:
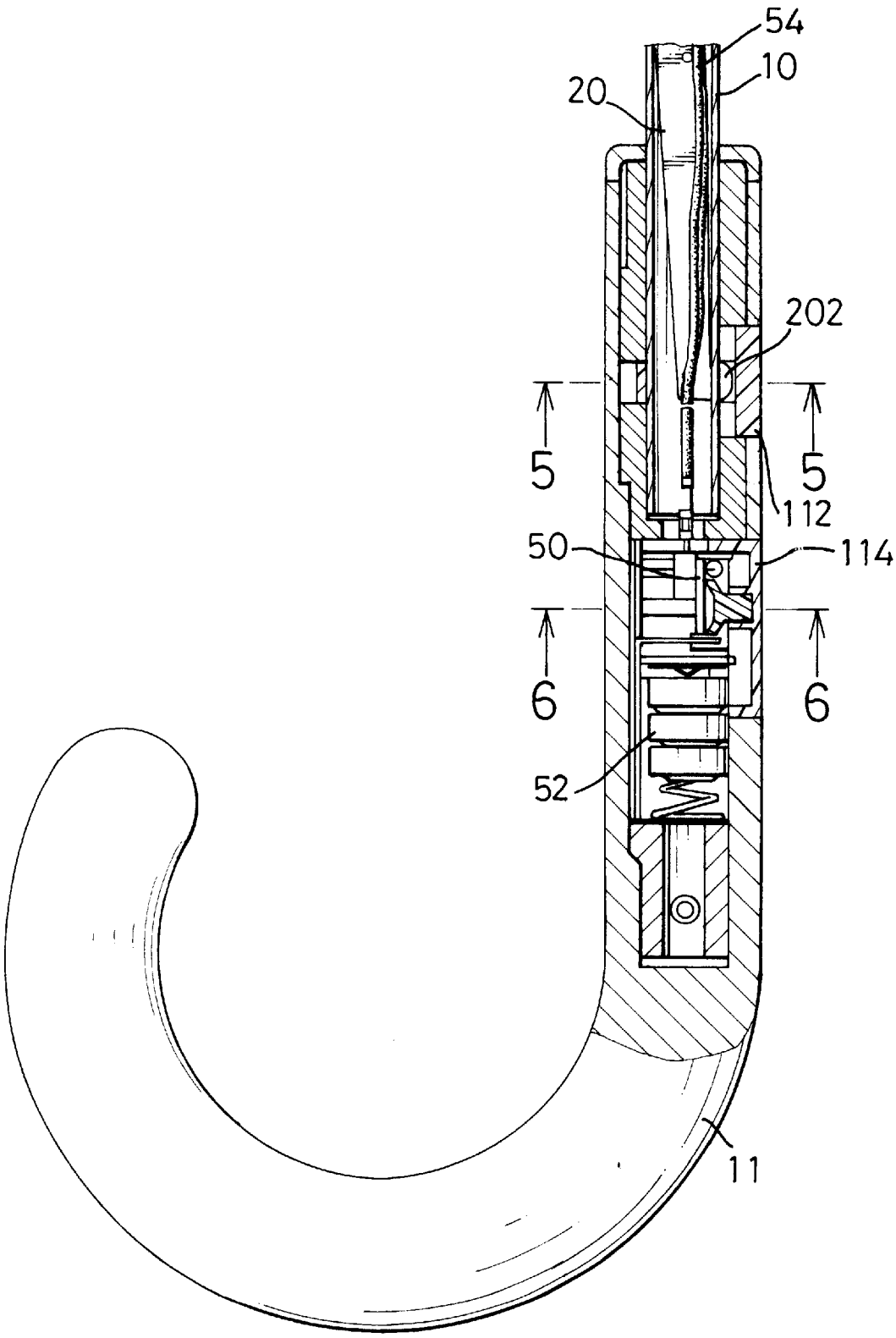
FIG. 3 is a front plan view in partial section of the handle and the shaft in FIG. 1.
Figure 4:
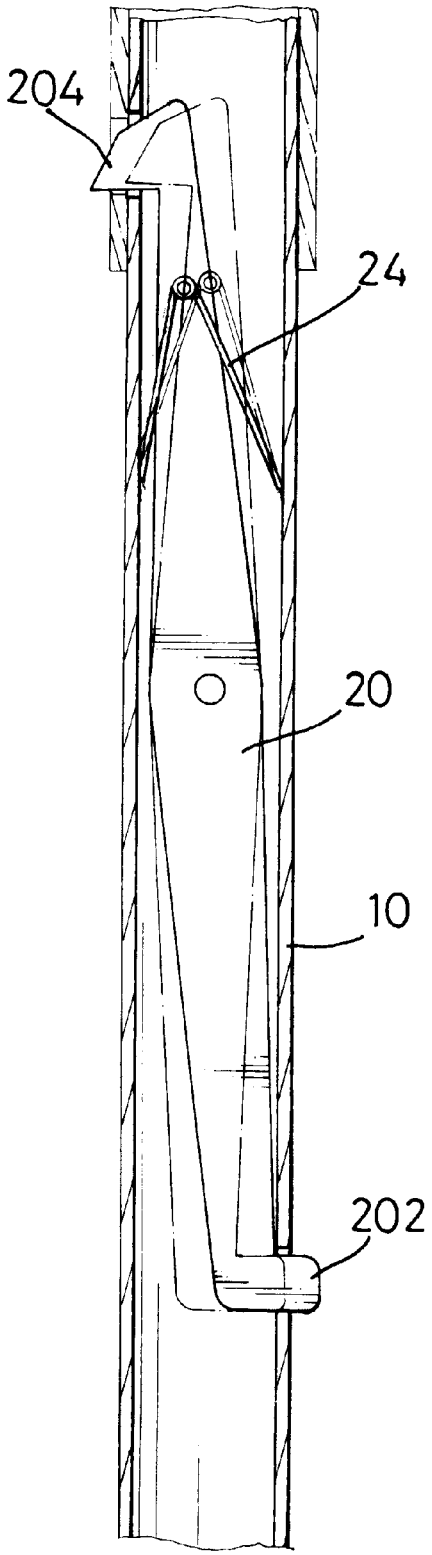
FIG. 4 is an operational side plan view of the lever in the shaft in FIG. 1.
Figure 6:
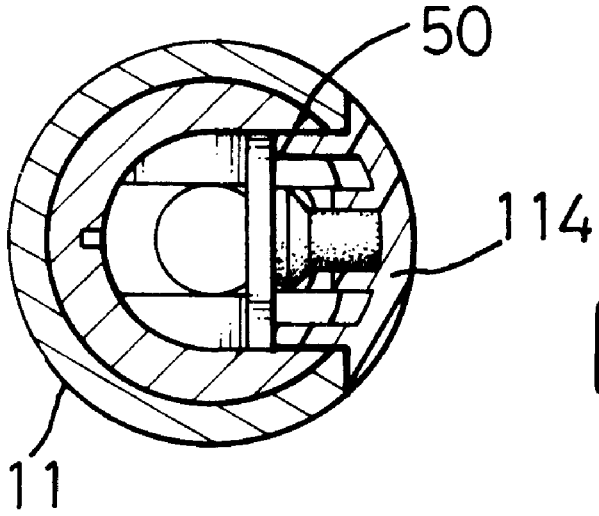
FIG. 6 is a cross sectional bottom plan view of the handle in FIG. 3 along the line 6—6.
Figure 5:
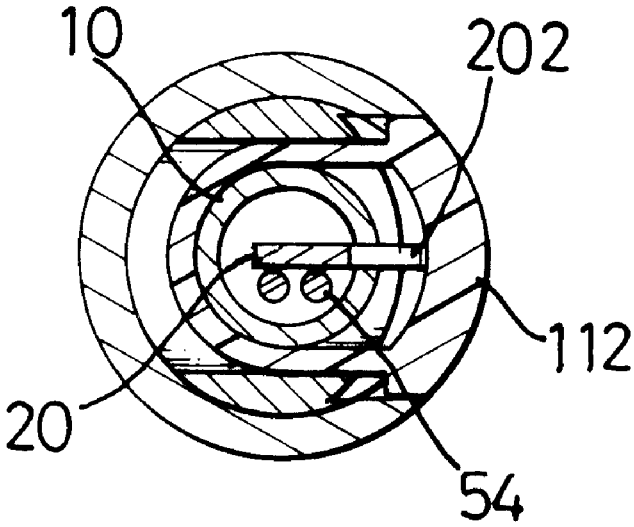
FIG. 5 is a cross sectional bottom plan view of the handle in FIG. 3 along the line 5—5.
Figure 7:
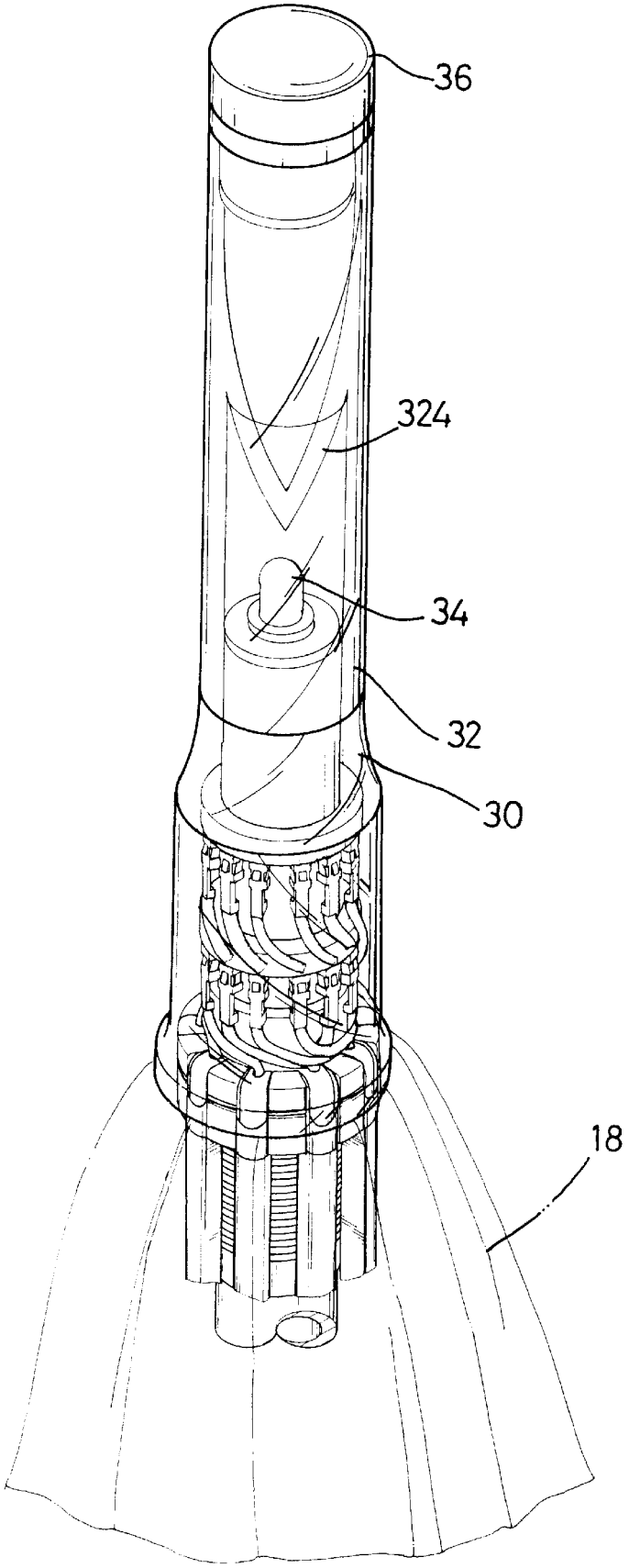
FIG. 7 is a perspective phantom view of the top illumination assembly and electrical connecting unit of the control assembly in accordance with the present invention.
Figure 8:
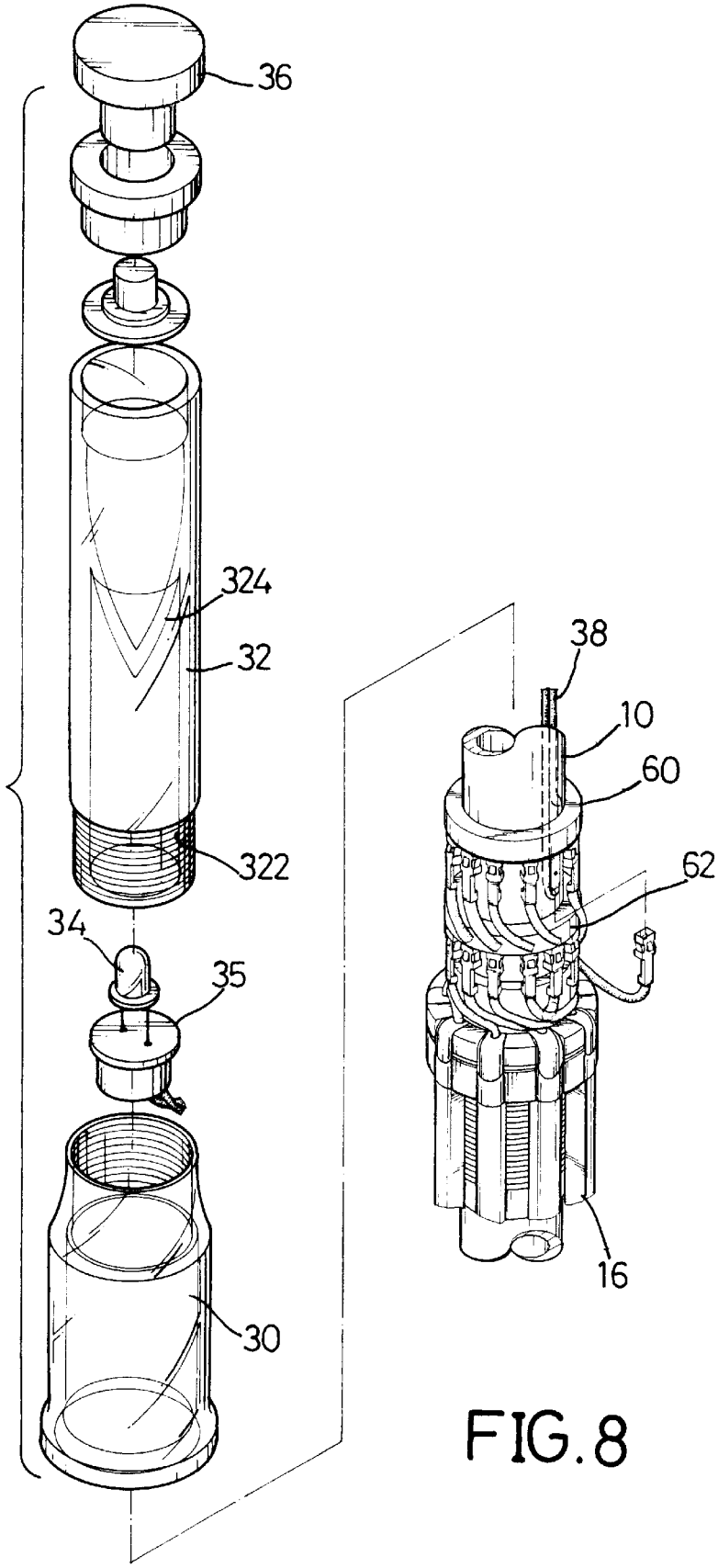
FIG. 8 is an exploded perspective view of the top illumination assembly in FIG. 7.

Referring to FIG. 1, an umbrella in accordance with the present invention comprises a shaft (10), a sliding hub (12), a stationary hub (17), multiple ribs (16), multiple spreaders (14), a canopy (18), a handle (11) and illumination devices. The sliding hub (12) is mounted and slides on the shaft (10). A stationary hub (17) is mounted near the top end of the shaft (10). The multiple ribs (16) are pivotally connected to the stationary hub (17). A spreader (14) corresponds to each rib (16) and is pivotally connected to the sliding hub (12) and the corresponding rib (16). The canopy (18) is attached to and covers all of the ribs (16). An illumination device is mounted to the end of the shaft (10) above the canopy (18), and an illumination device is mounted on the tip (40) of each rib (16). The shaft (10) is a tubular member. A J-shaped handle (11) is mounted on the bottom end of the shaft (10) for a user to grip and hold the umbrella. A spring (15) is mounted between the sliding hub (12) and each rib (16) to provide a pulling force to each corresponding spreader (14).

Referring to FIGS. 1–4, a lever (20) is pivotally mounted in the shaft (10). The lever (20) has a protrusion (202) integrally formed on the bottom end of the lever (20) and extending outward from the shaft (10) in addition to the handle (11). A hook (204) is integrally formed on the top end of the lever (20) and extends outward from the shaft (10) to engage with the sliding hub (12). A pin is securely mounted on the lever (20). A torsion spring (24) is mounted on the pin (22) with the two ends abutting the inside of the shaft (10). A pushbutton (112) is mounted on the handle (11) in contact with the protrusion (202) of the lever (20). When the user pushes the pushbutton (112), the lever (20) will pivotally rotate relative to the shaft (10), the hook (204) will retract into the shaft (10) and disengage from the sliding hub (12). When the hook (204) disengages from the sliding hub (12), the sliding hub (12) will slide along the shaft (10) by the tension provided by the springs (15). Consequently, each rib (16) will be pushed and rotate relative to the shaft (10), and the canopy (18) will automatically expand into an open condition.

Figure 9:
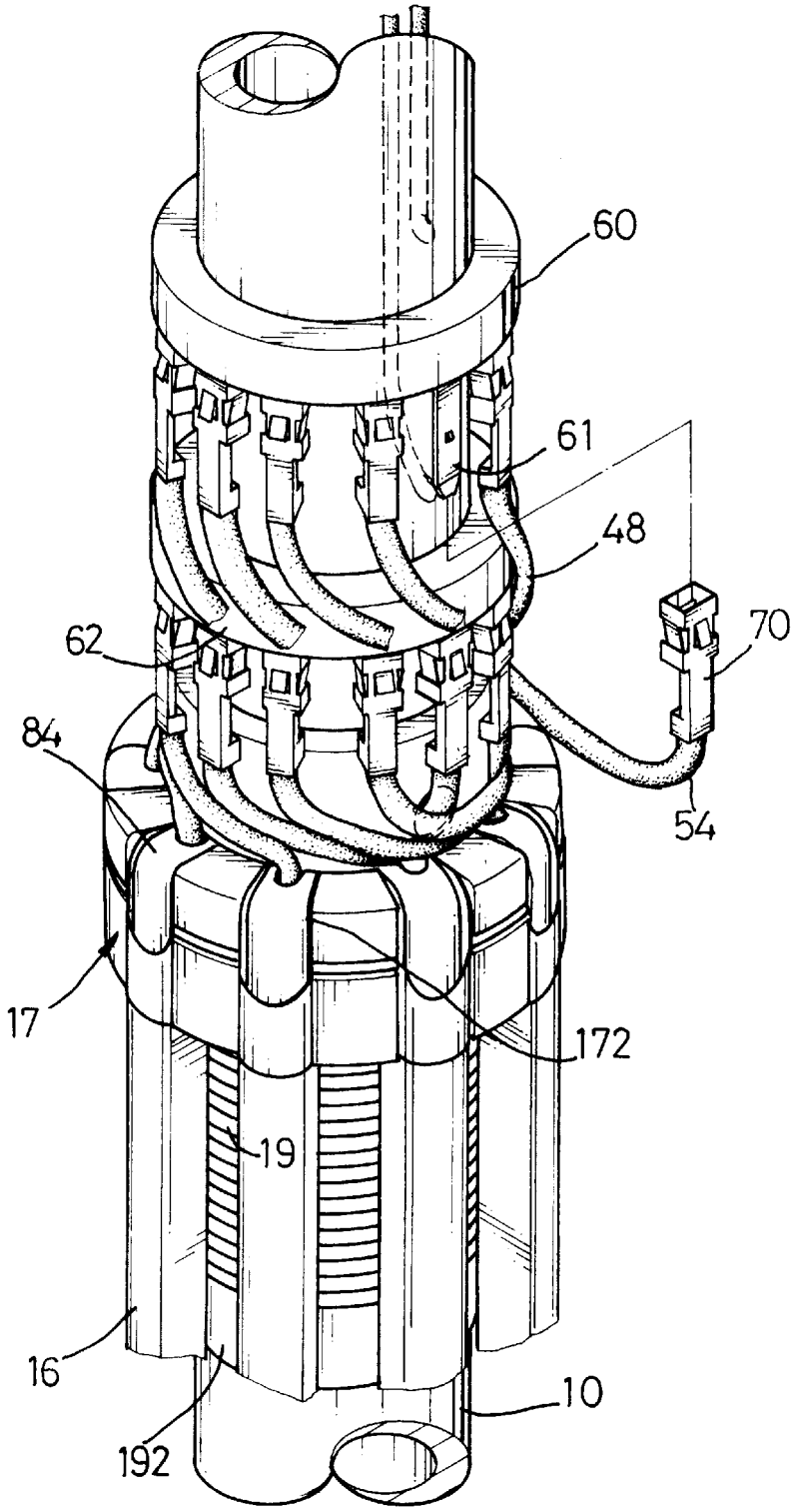
FIG. 9 is a perspective view of the electrical connecting unit in FIG. 7.
Figure 10:
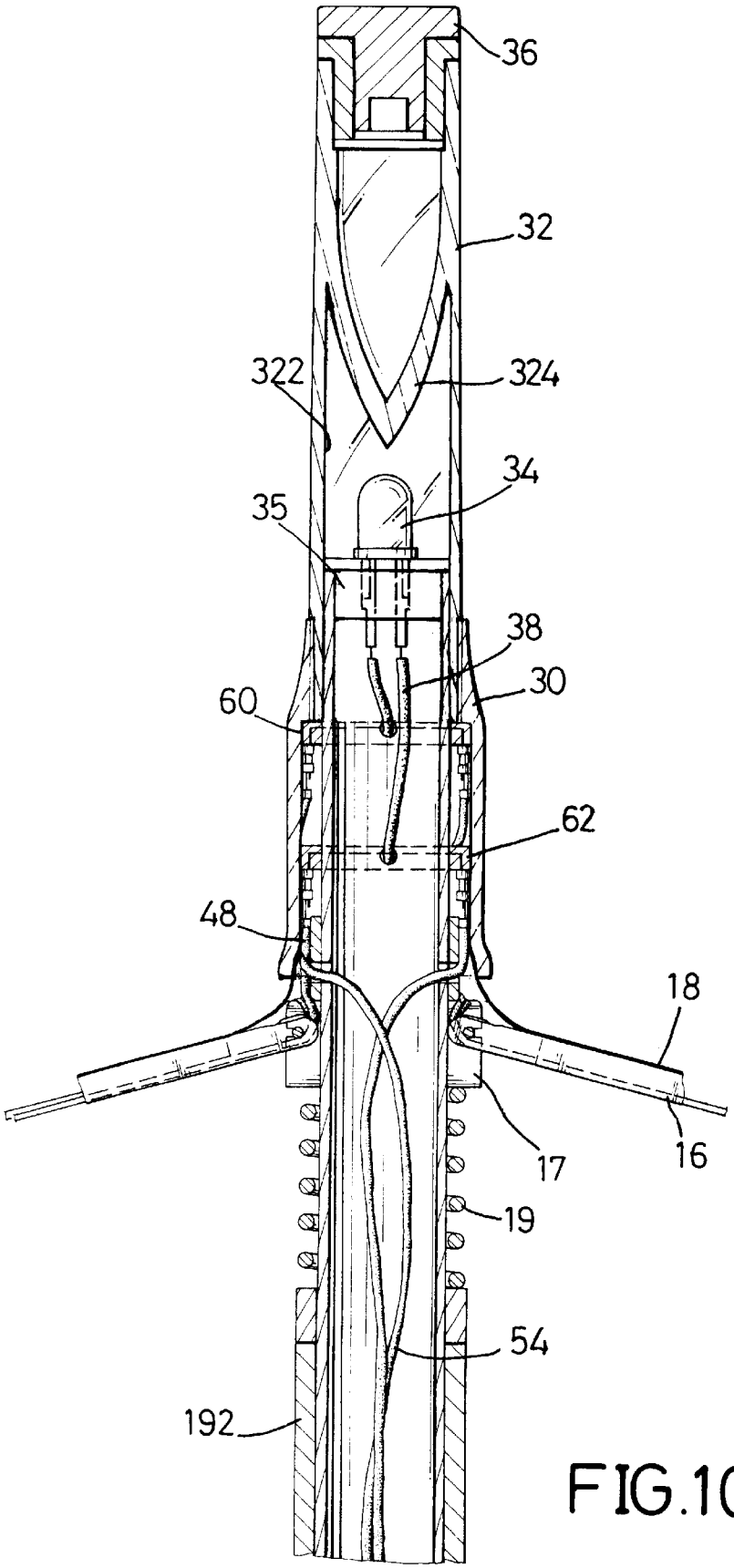
FIG. 10 is a side plan view in partial section of the top illumination assembly and the electrical connecting unit in FIG. 7.
Figure 11:
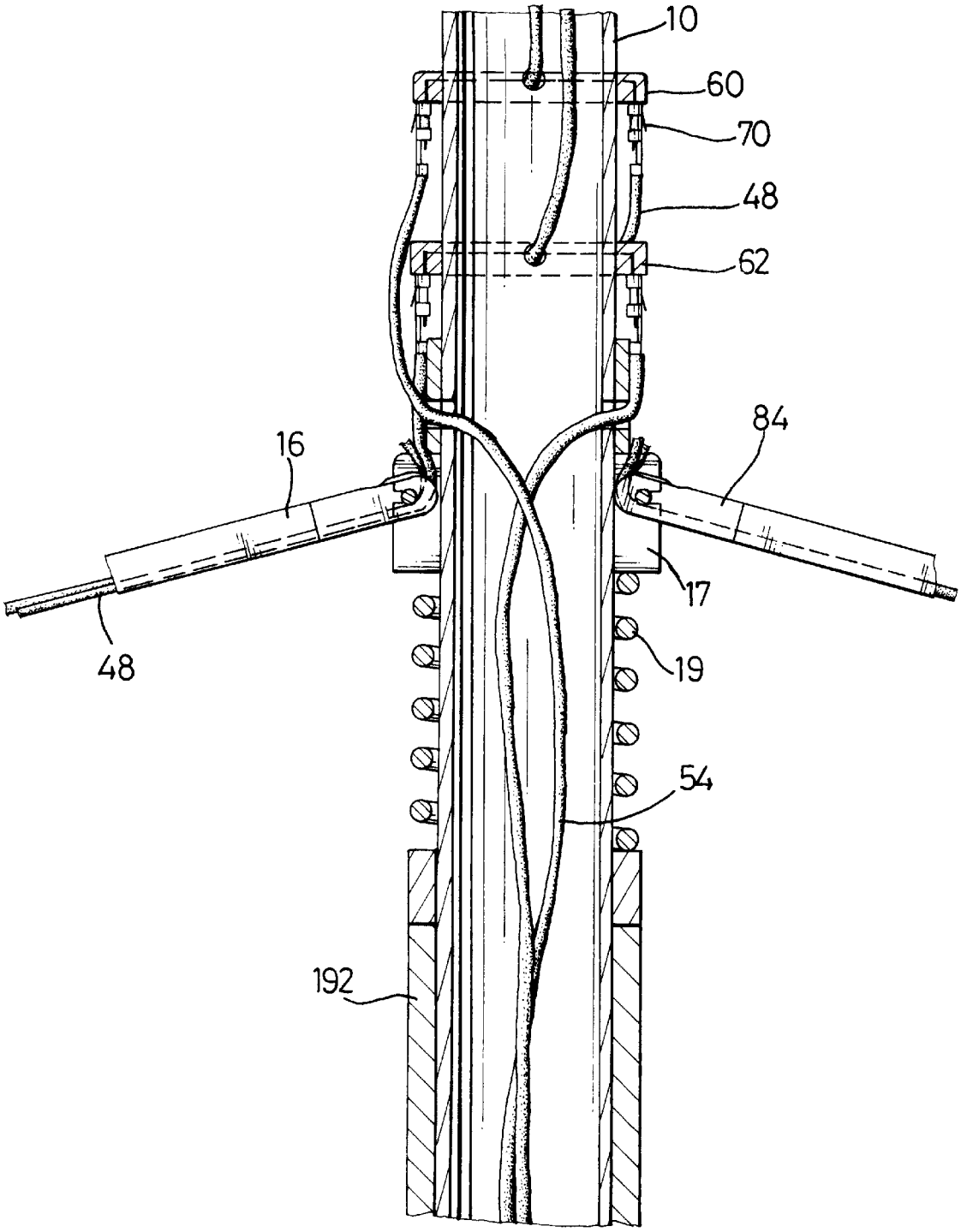
FIG. 11 is an expanded side plan view in partial section of the electrical connecting unit in FIG. 7.
Figure 12:
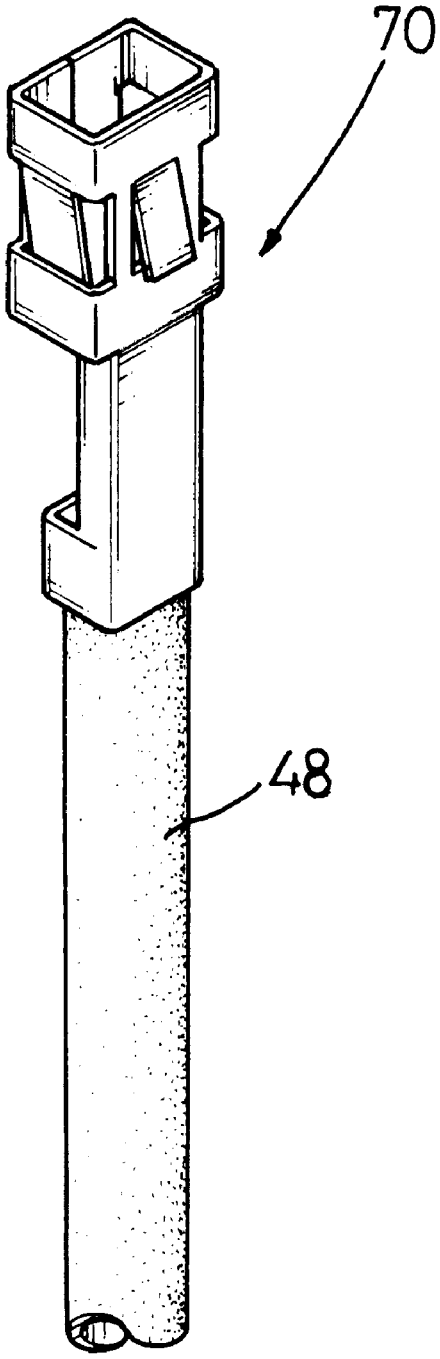
FIG. 12 is a perspective view of a connector connected to a wire in FIG. 9.

Referring to FIGS. 1 and 9–10, a spring (19) is mounted on the shaft (10) under the stationary hub (17), and a tubular stopper (192) mounted on the shaft (10) below the spring (19). When the sliding hub (12) moves toward the top of the shaft (10), the sliding hub (12) will bump into the stopper (192) and stop sliding along the shaft (10). The spring (19) can provide a shock absorbing effect to the sliding hub (12) and the stopper (192).

The illumination device comprises a top illumination assembly disposed on the top end of the shaft (10), a tip illumination assembly disposed on the free end of each rib (16) and a control assembly. With reference to FIGS. 7–11, the top illumination assembly comprises a transparent connecting tube (30), a transparent tubular member (32) and an LED (34). The connecting tube (30) is securely mounted on the top end of the shaft (10). The threaded end of the tubular member (32) with a central hole (322) is screwed onto the top end of the connecting tube (30). An internal wall (324) is integrally formed in the central hole (322) of the tubular member (32) to divide the central hole (322) into two portions. The LED (34) is received in the central hole (322) portion facing the connecting tube (30). The LED (34) is mounted on a base (35) that is fixedly mounted in the tubular member (30). An electrical wire (38) is connected to the anode of the LED (34), and another electrical wire (38) is connected to the cathode. In addition, a plastic or rubber plug (36) is attached to the other end of the central hole (322) to close the opening.

Figure 13:
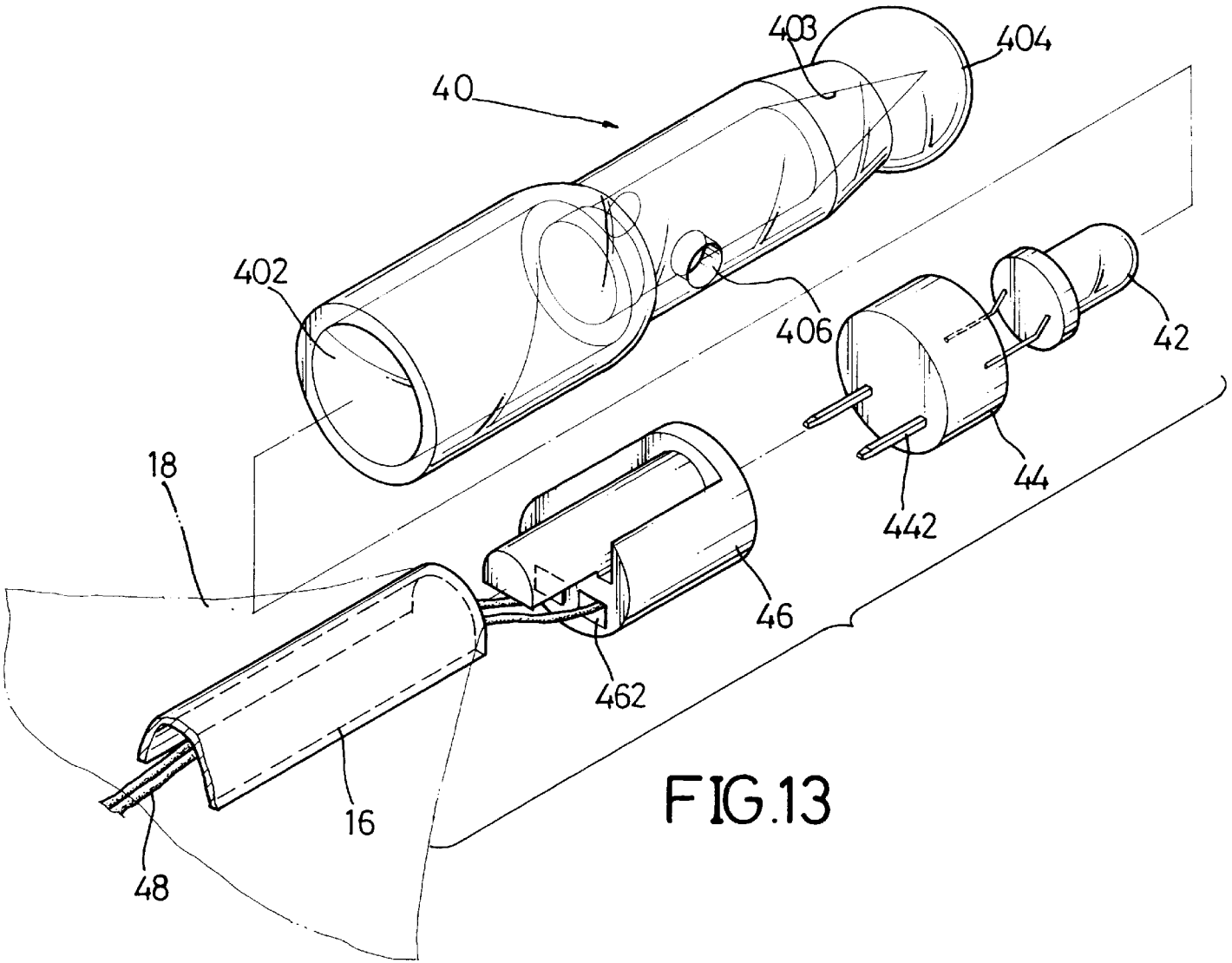
FIG. 13 is an exploded perspective view of a tip illumination assembly in accordance with the present invention.
Figure 14:
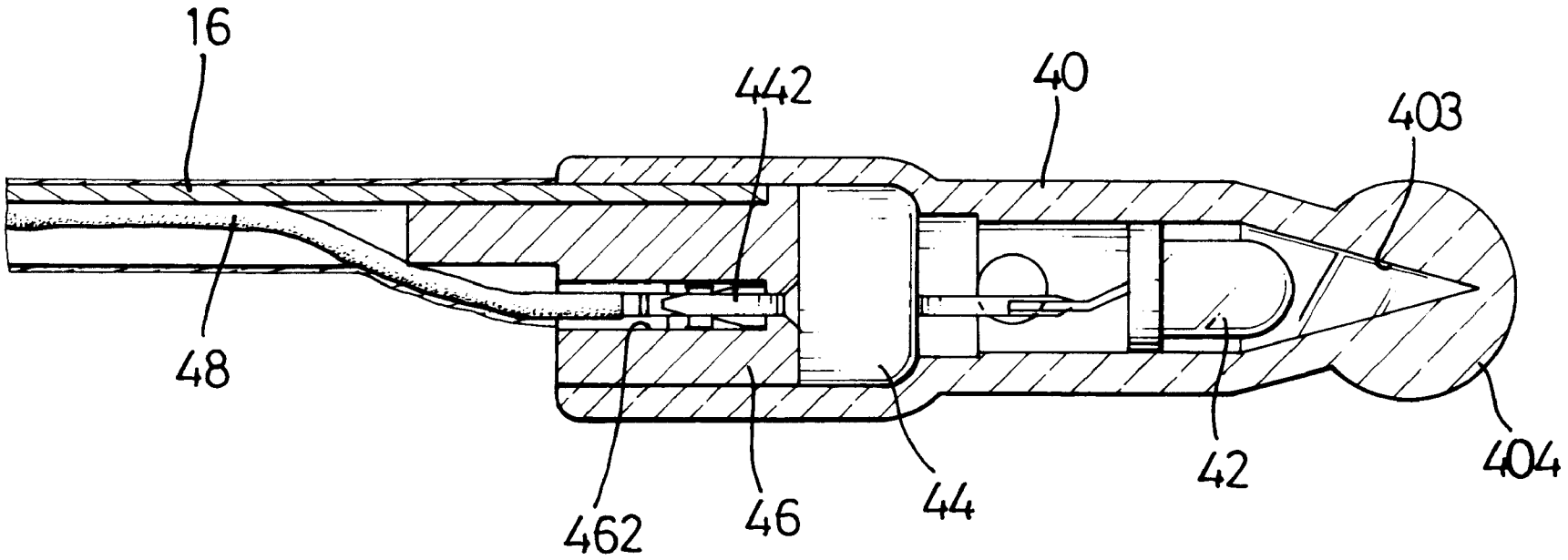
FIG. 14 is a side plan view in partial section of the tip illumination assembly in FIG. 13.
Figure 15:
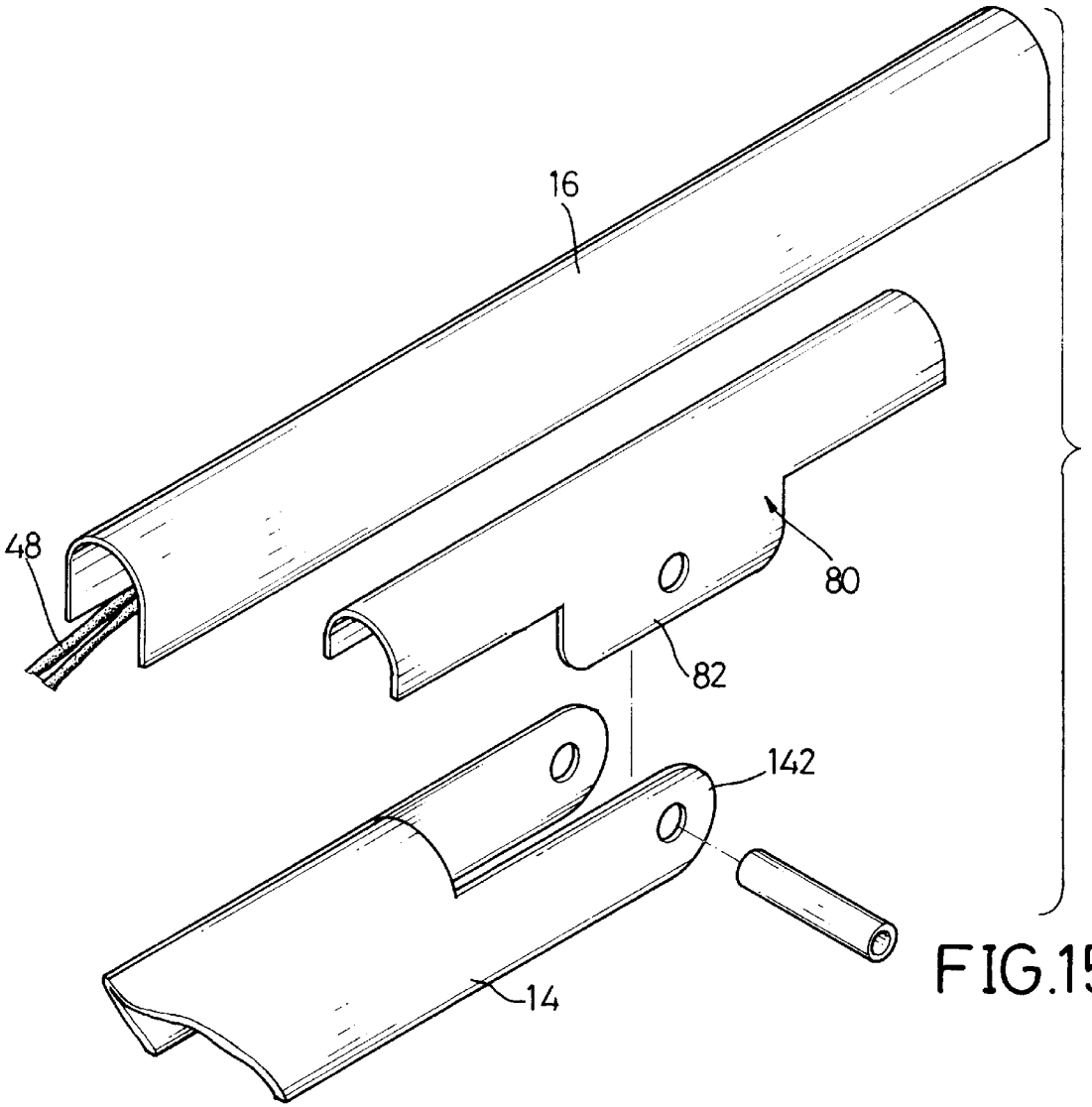
FIG. 15 is an exploded perspective view of the pivotal structure between a rib and spreader in FIG. 1.
Figure 16:
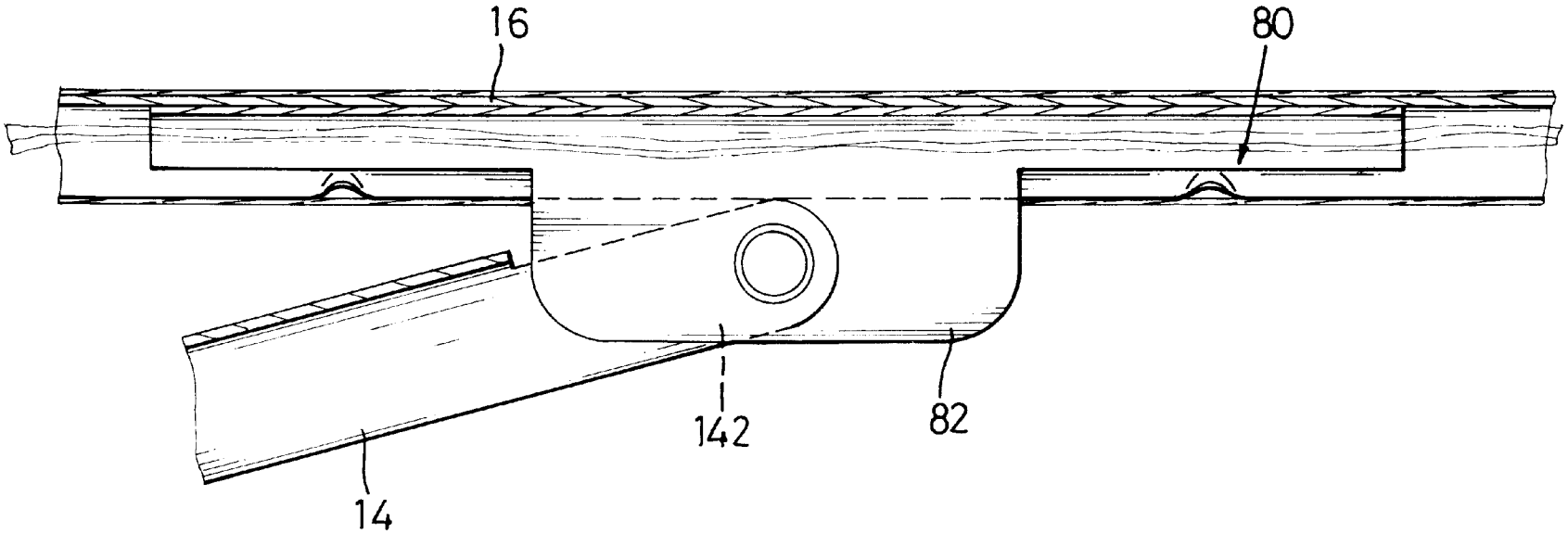
FIG. 16 is a side plan view in partial section of the pivotal structure in FIG. 15.
Figure 17:
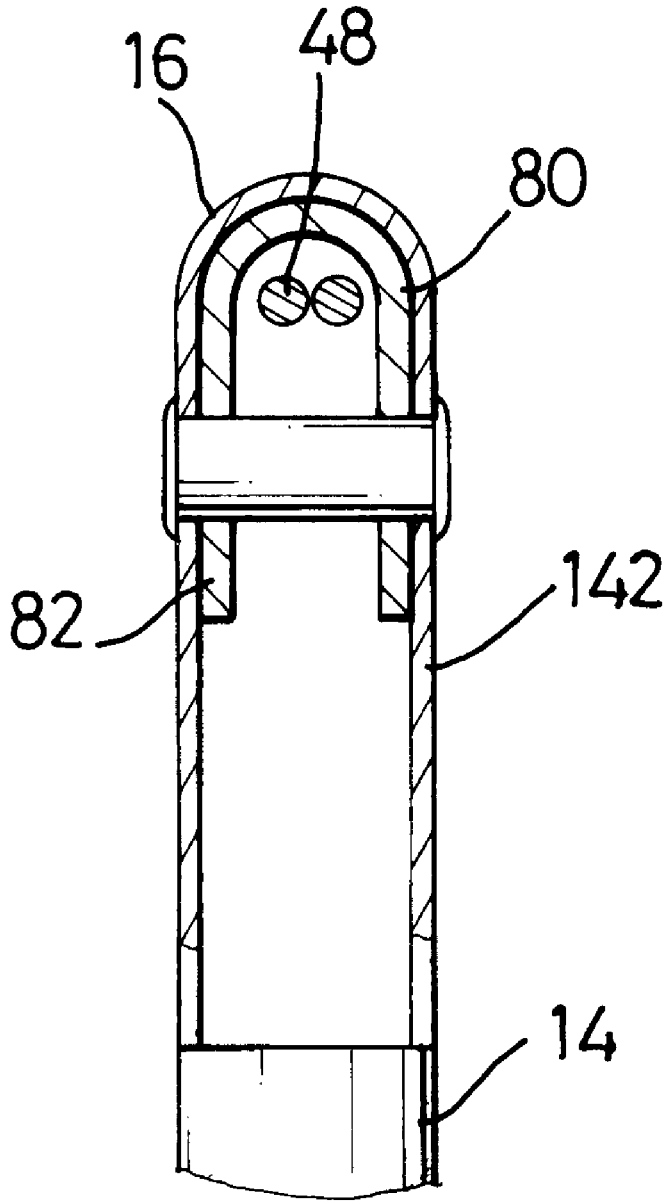
FIG. 17 is an end plan view in partial section of the pivotal structure in FIG. 15.
Figure 18:
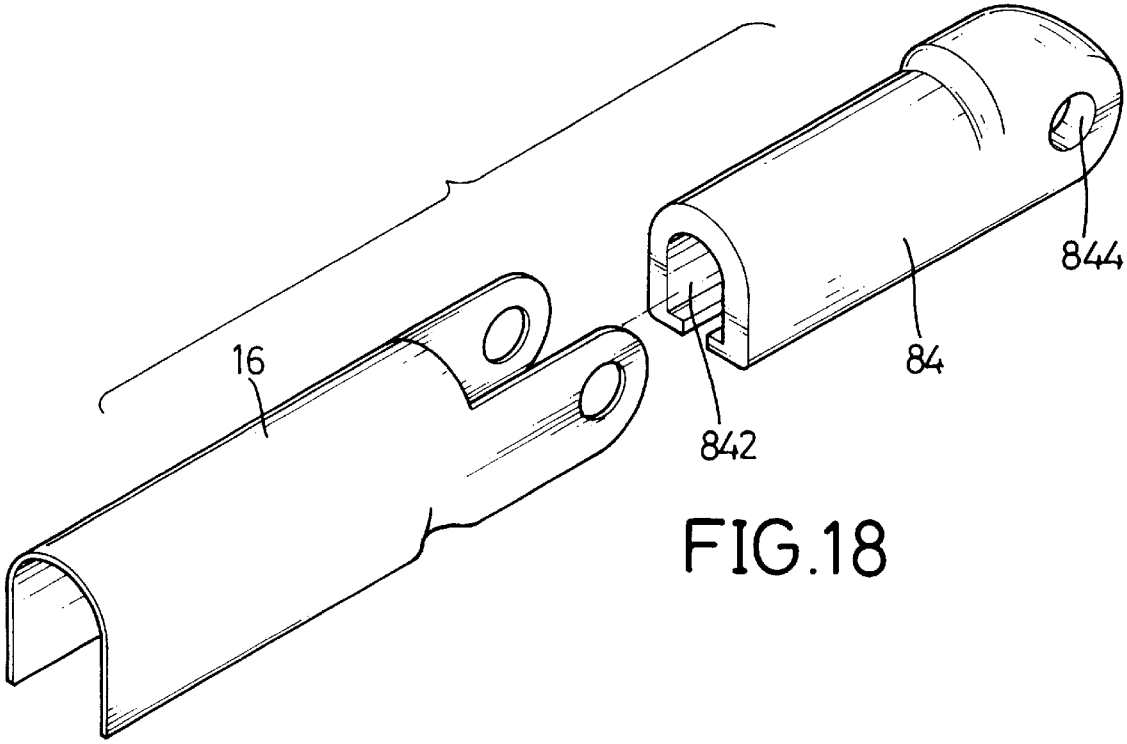
FIG. 18 is an exploded perspective view of a rib and a pivotal member in accordance with the present invention.
Figure 19:
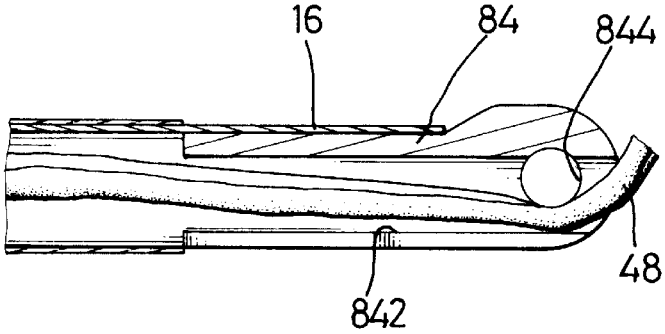
FIG. 19 is a side plan view in partial section of a rib and a pivotal member in FIG. 18.
Figure 20:
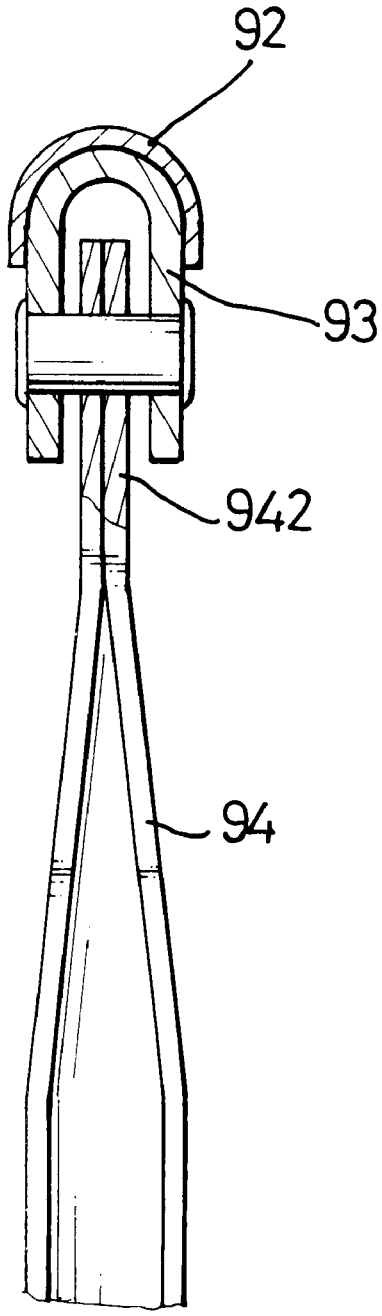
FIG. 20 PRIOR ART
FIG. 20 is an end plan view in partial section of a pivotal structure of a rib and a spreader in accordance with the prior art.
Figure 21:
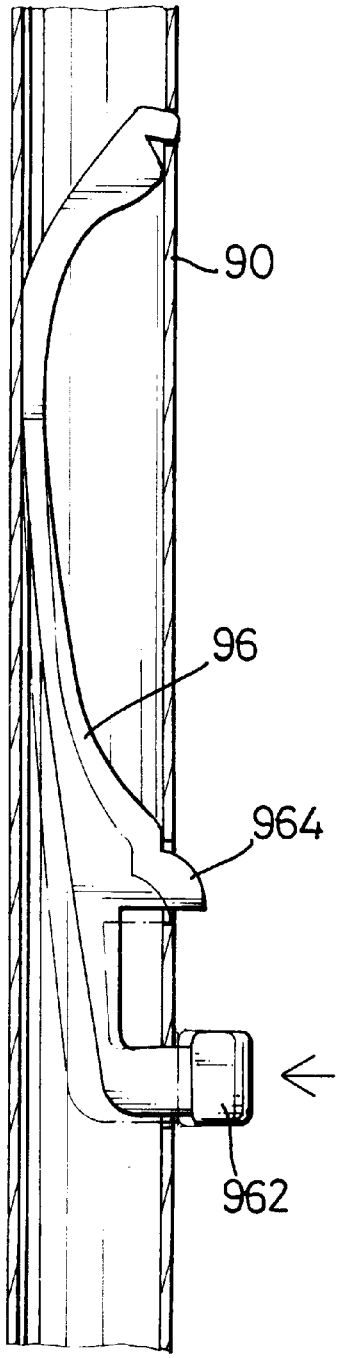
FIG.21 PRIOR ART
FIG. 21 is a side plan view in partial section of a control device for expanding the canopy from the folded situation in accordance with the prior art.

In reference with FIGS. 13 and 14, the tip illumination assembly is mounted on the free end of each rib (16) and comprises a transparent tip (40) and an LED (42). The tip (40) has a central hole (402) defined in one end and a ball (404) integrally formed on the other end. A conical hole (403) is defined at the closed end of the central hole (402). A base (44) is received in the central hole (402) to mount the LED (42). The base (44) has two prongs (442) extending toward the open end of the central hole (402) to connect with the anode and cathode of the LED (42), respectively. A branch electrical wire (48) received in each rib (16) is connected to each prong (442) of the base (44) to electrically connect to one of the anode and the cathode of the LED (42). An electrical socket (46) is received in the tip (40) that is securely attached to the free end of the corresponding rib (16). Each branch electrical wire (48) extends into a through hole (462) defined in the electrical socket (46). A radial through hole (406) is defined in the tip (40) and communicates with the central hole (402). When the tip (40) is attached to the free end of the corresponding rib (16). The edge of the canopy (18) will extend out to the radial through hole (406) on the tip (40), such that the canopy (18) can be fixed on the ribs (16) by stitching.

Referring to FIGS. 3 and 5–12, the control assembly comprises a control unit disposed in the handle (11) and an electrical connecting unit mounted near the top end of the shaft (10). The control unit is composed of a circuit board (50) with a switch mounted on the circuit board (50), at least one battery (52) electrically connected to the circuit board (50) and two main electrical wires (54) electrically connected to the switch. A switch button (114) is mounted on the handle (11) and is in contact with the switch on the circuit board (50). The two main electrical wires (54) are respectively connected to the anode and the cathode of the battery (52) through the switch.

The electrical connecting unit is composed of a first conducting ring (60) and a second conducting ring (62) each mounted near the top end of the shaft (10). The first and second conducting rings (60,62) are respectively connected with the electrical wires (38) connected to the anode and the cathode of the LED (34) on the top illumination assembly. Multiple contacts (61) extend longitudinally from each ring (60,62). A connector (70) is mounted on one end of each wire (48,54) to attach to the contact (61) of the conducting rings (60,62). The branch electrical wire (48) connected to the anode of the LED (42) of the tip illumination assembly (shown as in FIGS. 13 and 14) and the main electrical wire (54) connected to the anode of the battery (52) are connected to one of the contacts (61) on the first conducting ring (60). The other of each of the branch electrical wires (48) connected to the cathode of the LED (42) of the tip illumination assembly and the other of the main electrical wires (54) connected to the cathode of the battery (52) are connected to one of the contacts (61) on the second conducting ring (62).

In operation, when the user pushes the switch button (114) on the handle (11), the switch on the circuit board (50) is turned on. The electricity in the battery (52) will be transmitted to all of the LEDs (34, 42) through the wires (38, 48, 54). Because the internal wall (324) is formed in the tubular member (32) (as shown as in FIG. 10) and a conical hole (403) is defined in each tip (40) (as shown as in FIG. 14), the light from the LEDs (34, 42) reflected by the angular arrangement, such that the transparent tubular member (32) and the tip (40) will become lighting members. This provides good illumination on a dark rainy night. The safety of using the umbrella is improved.

Referring to FIGS. 1 and 15–17, each rib (16) has a U-shaped cross section to receive the branch electrical wires (48). A U-shaped connecting member (80) is mounted in the middle point of each rib (16). A tab (82) with a bore defined therein integrally extends downward from each side of the connecting member (80). Two ears (142) extend laterally from one end of each spreader (14) to pivotally connect with the corresponding tabs (82) of the connecting member (80) by a pivot pin.

Referring to FIGS. 9–11, 18 and 19, a pivotal member (84) is fixedly attached to the end of each rib (16) that is connected to the stationary hub (17). A pivot hole (844) is defined in the pivotal member (84) to pivotally mount onto a recess (172) defined in the stationary hub (17) with a pivot pin. A central hole (842) is laterally defined through the pivotal member (84) so the branch electrical wires (48) can pass through the inside of the pivotal member (84) and can connect with the corresponding conducting rings (60,62), such that the pivotal member (84) will not interfere with the branch electrical wires (48). Consequently, the manufacture of the umbrella with an illumination device can be simplified.

What is claimed is:

1. An umbrella comprising:

a shaft;

a sliding hub slidably mounted on the shaft;

multiple ribs;

a spreader pivotally mounted between the sliding hub and each rib;

a canopy covering all of the ribs; and an illumination device having a top illumination assembly disposed on a top end of the shaft, a tip illumination assembly disposed on a free end of each rib and a control assembly to provide electrical power to each illumination assembly;

wherein the top illumination assembly comprises a transparent connecting tube securely mounted on the top end of the shaft, a transparent tubular member detachably attached to a top end of the connecting tube, an internal wall integrally formed in the tubular member to divide the tubular member into two portions, a first LED received in the tubular member and two electrical wires connected with an anode and a cathode of the first LED respectively;

the tip illumination assembly comprises a transparent tip securely attached to a free end of each rib, a conical hole is defined in each tip, an LED received in each tip and two branch electrical wires connected with an anode and cathode of the LED, respectively;

each tip has a central hole defined in one end and a ball integrally formed on the other end;

a base is received in the central hole of each tip to mount the LED;

two prongs extend from the base to connect with the anode and cathode of the LED, respectively;

each branch electrical wire is connected to one of the prongs of the base; and the control assembly comprises a control unit disposed in the shaft, an electrical connecting unit connected to the electrical wires connecting to the LED in the top illumination assembly and to the branch electrical wires connecting to the LED in the tip illumination assemblies and two main electrical wires connected between the control unit and the electrical connecting unit, wherein the electrical connecting unit is composed of a first conducting ring and a second conducting ring;

the first conducting ring is connected with one of the electrical wires that is connected to the anode of the LED in the top illumination assembly and one of the branch electrical wires that is connected to the anode of the LED in the tip illumination assembly; and the second conducting ring is connected with the other one of the electrical wires that is connected to the cathode of the LED in the top illumination assembly and the other one of the branch electrical wires that is connected to the cathode of the LED in the tip illumination assembly, and wherein each conducting ring has multiple contacts longitudinally extending therefrom; and a connector is mounted on one end of each wire to connect to the contact of the conducting rings.

2. The umbrella as claimed in claim 1, wherein a plug is attached to a top end of the tubular member.

3. The umbrella as claimed in claim 1 wherein a radial through hole is defined in the tip and communicates with the central hole to attach the canopy.

4. The umbrella as claimed in claim 1, wherein an electrical socket is received in the tip and securely attached to the free end of the corresponding rib; and a through hole is defined in the electrical socket for each branch electrical wire to pass through the socket.

5. The umbrella as claimed in claim 1, wherein a handle is fixedly mounted on a bottom end of the shaft to receive the control unit.

6. The umbrella as claimed in claim 5, wherein the control unit is composed of a circuit board, a switch mounted on the circuit board in addition to electrically connecting with the two main electrical wires and at least one battery to the circuit board.

7. The umbrella as claimed in claim 6, wherein a switch button is mounted on the handle and is in contact with the switch on the circuit board.

8. The umbrella as claimed in claim 7, wherein the first conducting ring is connected with one of the main electrical wires that is connected to an anode of the battery; and the second conducting ring is connected with the other one of the main electrical wires that is connected to a cathode of the switch.

9. The umbrella as claimed in claim 1, wherein each rib has a U-shaped cross section to receive the branch electrical wires therein; and wherein a U-shaped connecting member is mounted at the middle point of each rib;

a tab with a bore defined therein integrally extends downward from each side of the connecting member; and two ears extend laterally from one end of each spreader to pivotally connect with the tabs on the corresponding connecting member.

10. The umbrella as claimed in claim 1 further comprising a lever pivotally mounted in the shaft;

a protrusion integrally formed on a bottom end of the lever and extending out of the shaft;

a hook integrally formed on a top end of the lever and extending out of the shaft to engage with the sliding hub;

a torsion spring mounted on the lever and having two ends each abutting an inside of the shaft; and a pushbutton mounted on the shaft in contact with the protrusion.

11. The umbrella as claimed in claim 1 further comprising a stationary hub mounted near the top end of the shaft so that all of the ribs are pivotally connected to the hub.

12. The umbrella as claimed in claim 11, wherein a pivotal member is fixedly mounted on the end of each rib and is connected to the stationary hub, a pivot hole is defined in the pivotal member to pivotally attach the pivoting member to the stationary hub with a pivot pin; and a central hole is laterally defined through the pivotal member to allow the branch electrical wires to pass through the pivoting member.

13. The umbrella as claimed in claim 1, with the first conducting ring having an internal diameter of a size corresponding to and for slideable receipt on the shaft, with the second conducting ring having an internal diameter of a size corresponding to and for slideable receipt on the shaft and of a size corresponding to the first conducting ring, with the first and second conducting rings being axially spaced on the shaft.

14. An umbrella comprising:

a shaft;

a sliding hub slidably mounted on the shaft;

multiple ribs;

a spreader pivotally mounted between the sliding hub and each rib;

a canopy covering all of the ribs; and an illumination device having at least a top illumination assembly disposed on a top end of the shaft and a control assembly to provide electrical power to each illumination assembly, with the top illumination assembly comprising a transparent tubular member with a central hole extending between first and second ends, with the transparent tubular member being detachably attached relative to the shaft with the central hole extending parallel to the shaft, an internal wall integrally formed in the central hole intermediate the first and second ends and dividing the central hole into first and second portions, a first LED for emitting light and received in the first portion of the central hole and located intermediate the internal wall and the shaft, with electrical power being provided by the control assembly to the LED, and a plug at the second end of the tubular member for closing the central hole, with the internal wall reflecting light emitted by the first LED.

15. The umbrella as claimed in claim 14, with the internal wall being generally conical in shape having a base which is integrally connected to the transparent tubular member and which terminates in a point, with the point located intermediate the LED and the base.

16. The umbrella as claimed in claim 15, with the top illumination assembly further comprising, in combination: a transparent connecting tube removably securely mounted to the top end of the shaft, with the shaft being of a size corresponding to and for slideable receipt within the central hole, with a lower end of the transparent tubular member including outer threads detachably attached to inner threads of a top end of the transparent connecting tube, and with a portion of the control assembly located between the transparent connecting tube and the shaft below the transparent tubular member.

17. The umbrella as claimed in claim 16, with the illumination device further having a tip illumination assembly disposed on a free end of at least one of the multiple ribs, with the tip illumination assembly comprising a transparent tip securely attached to a free end of the rib, with the transparent tip having a first end and a second end, with a ball being integrally formed on the transparent tip adjacent the second end, with a tip central hole extending from the first end towards but spaced from the second end and the ball, with a conical hole extending from the tip central hole towards but spaced from the second end and from outwardly of the ball into the ball, and a second LED for emitting light and received in the tip central hole and spaced from the ball and the conical hole, with the conical hole reflecting light emitted by the second LED.

18. An umbrella comprising:

a shaft;

a sliding hub slidably mounted on the shaft;

multiple ribs;

a spreader pivotally mounted between the sliding hub and each rib;

a canopy covering all of the ribs; and an illumination device having at least a tip illumination assembly disposed on a free end of at least one of the multiple ribs and a control assembly to provide electrical power to each illumination assembly, with the tip illumination assembly comprising a transparent tip securely attached to a free end of the rib, with the transparent tip having a first end and a second ends with a ball being integrally formed on the transparent tip adjacent the second end, with a tip central hole extending from the first end towards but spaced from the second end and the ball, with a conical hole extending from the tip central hole towards but spaced from the second end and from outwardly of the ball into the ball, and a LED for emitting light and received in the tip central hole and spaced from the ball and the conical hole, with the conical hole reflecting light emitted by the LED).

19. The umbrella as claimed in claim 18, with the tip illumination assembly further including a radial through hole communicating with the central hole and for receiving stitching for fixing the canopy to the rib.

20. The umbrella as claimed in claim 18, with the transparent tip including a frustoconical portion having a first portion of a larger size than a second portion, with the ball extending from the second portion and being of a size larger than the second portion, with the conical hole extending from the tip central hole adjacent to the first portion of the frustoconical portion.

* * * * *